US009858761B2

(12) United States Patent
Zimmerl

(10) Patent No.: US 9,858,761 B2
(45) Date of Patent: Jan. 2, 2018

(54) REAL TIME BETTING SYSTEM AND METHOD INCLUDING A JACKPOT FOR SHORT TIME INTERVAL EVENTS

(71) Applicant: NOVOMATIC AG, Gumpoldskirchen (AT)

(72) Inventor: Martin Zimmerl, Baden (AT)

(73) Assignee: Novomatic AG, Gumpoldskirchen (AT)

( * ) Notice: Subject to any disclaimer, the term of this patent is extended or adjusted under 35 U.S.C. 154(b) by 364 days.

(21) Appl. No.: 14/170,593

(22) Filed: Feb. 1, 2014

(65) Prior Publication Data

US 2014/0221063 A1 Aug. 7, 2014

Related U.S. Application Data

(60) Provisional application No. 61/760,128, filed on Feb. 3, 2013, provisional application No. 61/760,407, filed on Feb. 4, 2013.

(51) Int. Cl.
*G07F 17/32* (2006.01)

(52) U.S. Cl.
CPC ..... *G07F 17/3258* (2013.01); *G07F 17/3227* (2013.01); *G07F 17/3234* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 5,550,127 | A * | 8/1996 | Pantano | A61K 31/401 514/248 |
| 6,575,832 | B1 | 6/2003 | Manfredi et al. | |
| 8,038,527 | B2 | 10/2011 | Walker et al. | |
| 8,282,488 | B2 | 10/2012 | Walker et al. | |
| 8,393,960 | B2 | 3/2013 | Andersn et al. | |
| 2004/0235542 | A1 | 11/2004 | Stronach | |
| 2005/0125244 | A1 | 6/2005 | Schneider | |
| 2005/0176507 | A1 * | 8/2005 | Ephrati | G07F 17/3288 463/39 |
| 2006/0287072 | A1 | 12/2006 | Walker et al. | |
| 2006/0287098 | A1 | 12/2006 | Morrow et al. | |
| 2007/0026939 | A1 | 2/2007 | Asher et al. | |

(Continued)

*Primary Examiner* — Milap Shah
*Assistant Examiner* — Robert T Clarke, Jr.
(74) *Attorney, Agent, or Firm* — Kevin H. Fortin

(57) ABSTRACT

A real-time betting system includes an event control server enabled to communicate data via a network. The event control server communicates gaming event information to various system components and an event control database for collecting and storing event data. A real-time betting system server communicates in operative communication with the event control server and includes an odds transformation module for transforming probabilities to odds. The system has a bookmaker server and a plurality of betting devices in operative communication with the event control server. The real-time betting system server enables a jackpot payout possibility for each bet enabled by the bookmaker server. The betting devices receive event information, including odds. Bets placed at the betting devices are communicated to the bookmaker server. The events having a short time interval and are selectively communicated to the betting devices to enable bets to be placed.

12 Claims, 4 Drawing Sheets

(56) References Cited

U.S. PATENT DOCUMENTS

| | | | | |
|---|---|---|---|---|
| 2008/0096645 | A1 | 4/2008 | Frerking et al. | |
| 2008/0113816 | A1* | 5/2008 | Mahaffey | G07F 17/32 463/42 |
| 2011/0275425 | A1* | 11/2011 | Asher | G07F 17/32 463/6 |
| 2012/0185344 | A1* | 7/2012 | Schrotter | G06Q 20/20 705/21 |
| 2013/0059635 | A1* | 3/2013 | Payne | A63F 1/00 463/11 |

* cited by examiner

| Intervall Limits Terminals | | | Number of Races | | Number of | | Average number |
|---|---|---|---|---|---|---|---|
| Minimum Number of Terminals | Maximum Number of Terminals | Total Stake per Race (€) | needed for Desired Race Pot Value | Jackpot Hitrate | Race 66 needed to hit the Jackpot | Probability of Race 66 occurance | of races between two Race 66 |
| 1 | 25 | 2,5 | 250,00 | 13,01% | 7,69 | 0,03075 | 32,5 |
| 26 | 50 | 5 | 125,00 | 24,33% | 4,11 | 0,03288 | 30,4 |
| 51 | 100 | 10 | 62,50 | 42,74% | 2,34 | 0,03744 | 26,7 |
| 101 | 150 | 15 | 41,67 | 56,67% | 1,76 | 0,04235 | 23,6 |
| 151 | 200 | 20 | 31,25 | 67,21% | 1,49 | 0,04761 | 21,0 |
| 201 | 300 | 30 | 20,83 | 81,22% | 1,23 | 0,05910 | 16,9 |
| 301 | 500 | 50 | 12,50 | 93,84% | 1,07 | 0,08525 | 11,7 |
| 501 | 1000 | 100 | 6,25 | 99,60% | 1,00 | 0,16064 | 6,2 |

| | |
|---|---|
| Desired Race Pot Value | 500 |
| Stake Percentage Primary Race | 80% |
| Default Stake Race 66 | €0,10 |

Fig. 3

REAL TIME BETTING SYSTEM AND METHOD INCLUDING A JACKPOT FOR SHORT TIME INTERVAL EVENTS

FIELD OF THE INVENTION

The invention relates to real-time betting systems, hardware and methods that enable a jackpot payout.

BACKGROUND OF THE INVENTION

Gaming machines are typically found in casinos and amusement arcades. They offer entertainment and gaming pleasure to many. Various types of gaming machines, including slot machines, are popular with the gaming public. Betting slot machines enable bets to be placed on events, for example, sporting performances and racing events. Reel slot machines have several rotating reels with various play icons arranged in the display panel's viewing windows or electronically on display screens.

Gaming machines are typically constructed as a kiosk, which is a stationary floor-mounted appliance having a front side with a user interface. In some cases, there is more than one interface in the upper section of the housing so that they can be observed or tracked from a user station in front of the housing. The interface may include a touch-screen, keys, buttons and a lever for rotating reels. Gaming machines may also include web-enabled personal computers programmed with software to enable on-line betting. In such cases, a mouse, keyboard, touch pad, or touch screen interface may be used.

An operator's panel included in the interface typically includes several control buttons are provided below at least one display. The operator's panel may be a touch screen with buttons that are illuminated, flashing, or displaying images. The touch screen eight may be the ventral height of a player standing in front of the device. Control buttons may be manually operated and may serve, among other things, to set reels of a reel slot machine in motion, or to stop them. The device's various functional building blocks, like the game controller, a currency authentication device, and/or a currency collection apparatus, can be accommodated within the housing's interior.

These kinds of gaming and entertainment devices are routinely set up in groups in a casino or in an amusement arcade. In this context, the devices can be arranged in rows next to one another, arranged radially, in a star-shaped manner, or around a column. There are numerous ways to arrange gaming and entertainment devices.

Racing games, such as slot-car or horse racing games for example, are known as games in which a plurality of characters race. Such races have a short time interval. Normally short time interval events last less than several minutes. The short time interval makes watching a race both possible and exciting. Attending live short time interval races is inconvenient for many, so various gaming machines on the market provide video of a current, or recorded event to a user.

U.S. Pat. No. 6,848,991 discloses a betting system where a bet is made on an event character selected from a plurality of event characters. Odds are determined in advance for each character. An award is provided on the basis of the odds that the character has finished in a predetermined finishing order, thus qualified for the award. Users may bet on a stronger character, and thus the odds thereof are lowered for the character at the last minute. The users having bet to win may only receive their wager back, and only take risks with no gain, even in a case where the character takes first place.

U.S. Patent Publication No. US 2009/0233671 presents a system and method that a) periodically sums up bets made by players and received by a gaming terminal, (b) calculates the latest odds on the basis of the latest sum-up result and (c) display the odds to enable further bets. This enables the odds to periodically change during the course of a racing game. The odds periodically change on the onset of the predetermined time deadline for the bet, the performance of the racing characters and on betting patterns.

One great challenge to gaming machine makers is the challenge to perfect the odd-making during the course of an event. Effectively perfecting the odd-making manages risks associated with having large payouts to numerous users for any particular event. Ideally any hold value amount retained by a system provider would exceed the net payouts of any particular event. This insures long term viability for those providing gaming entertainment to users.

Another challenge is to perform such in real-time so that a user can decide instantaneously when to place a bet. A further challenge is to make a system that can be used across multiple jurisdictions having diverse hold value requirements, where the hold value is a portion of a bet that is retained by the system provider.

SUMMARY OF THE INVENTION

The present system is designed to offer bets on certain events with a short interval. One example is betting on slot car races that take place in an interval of two to five minutes. The exact time between these races is not so important. However it would be impossible for a bookmaker to calculate odds within this time. In addition to slot car races, the present invention is applicable to horse races, automotive races, dog races, sporting events, other events, and segments of such events.

For racing events it is possible to bet on the winner, which is termed a winner bet. It is also possible to place an exacta bet, which is based on a combination of $1^{st}$ place and $2^{nd}$ place finishers in a race. An exacta bet typically is less likely to win, but has a higher payout if a win is achieved.

Sporting games, including table tennis, table soccer and the like are including within the scope of the present real-time betting system. The interval of these competitions is even shorter (about 40 seconds). Similar to the slot car races, the exact interval is not important.

In an embodiment of the present invention, there is provided a system enabling real-time betting (RTBS) on certain events with a short time interval. The system has an event control module to send different kinds of messages/information to the system components. The event control module includes an event control database for storing the information received from external sources, and an event control server for receiving event information from external sources and for communicating event messages to at least one RBTS server and a bookmaker server.

The system also has at least one Real-time Betting System Server module which includes an ODDTRANS (OTF) for transforming the probabilities of a particular result to the odds offered to the customer, and at least one general purpose computer functioning as Real-time Betting System Server for communicating with a plurality of the betting terminals via the common messaging protocol, and each Real-time Betting System Server providing a particular hold percentage for respective criterion.

The system further includes a plurality of betting devices. For example, each betting device includes a betting terminal, or terminals for interacting with a user. The betting devices may include a cash desk betting application in operative communication with the Real-time Betting System Server/s and the jackbet database of the bookmaker server. The betting terminals can be any of a variety of interactive devices, including kiosks, notepad computers, fixed touch-sensitive displays, or any mobile computing device, including a smart phone or laptop computer. The cash desk can be a physical device or simply a counter controlled by software and displayed on a betting device.

The betting terminals communicate via a network with a bookmaker server and a real-time betting server (RTBS). For managing the risk, there is a risk management server which includes a PION Server for receiving slip data from betting devices and in operative communication with risk analyzer database, PION database and risk analyzer module (RAL), and to collect all the data from the event control and all bet slips from the betting terminals, a PION database, a risk analyzer to evaluate risks and communicate evaluated risks to the bookmaker database and to compare the hold situation with the desired hold setting, and a risk analyzer database.

The bookmaker Service includes at least one general purpose computer as a bookmaker server for receiving data from the event control and requests for the parameter calculation, a bookmaker database for communicating business probabilities to at least one Real-time Betting System Server, a probability calculator module (PROBABILITY CALCULATOR) to calculate the natural probabilities, and a probability transform function module PROBTRANS (PTF) to transform natural probabilities to the business probabilities, so that the natural probabilities are transformed to generate a hold attractive for the players as well as bookmaker.

A calculation core module (CalCore) is also provided for parameter calculation and for communicating parameters to at least one Real-time Betting System Server, a jackbet database, and wherein said bookmaker server functions as a Jackbet Server to provide Jackbet services for Jackpot Management by collecting all bets related to Jackpot from the betting terminals, calculating the winnings, calculating basic probabilities, and obtaining the parameter values for delivering it to the betting terminals.

The events with a short interval include slot car races, horse races, automotive races, dog races, sporting events, and segments of such events and the information of the Event phase include information about New event, Place your bets, Finish betting, No more bets, Race, Results for the different kinds of events and the probabilities, like slot car races or Table Soccer matches.

The results for slot car races, include the possibility for a win bet, an exacta bet, and a tri-cast bet. A tri-cast bet indicates the first three place finishers. The various betting options are suggested to a user by the betting terminal. The betting options are managed by a random algorithm and an Over/Under Bet and the tri-cast combination can also be changed by the player to a different combination, such as a combination bet of the first 4 places. The Over/Under bet include ascertaining whether the finishing time of the winner under a certain time, and on reaching the desired Jackpot value, the time will be set to a value that is more likely to be beaten by the slot car drivers. For slot car race events, the business probabilities include all winner probabilities and each exacta probabilities.

The results for Table Soccer matches include the result 1/X/2, first goal and correct score. For table soccer match events, the business probabilities include all result, correct score and first goal probabilities using a set of monitored factors.

In another embodiment in accordance with the present invention, there is provided a system enabling real-time betting (RTBS) on certain events with a short interval, the system comprising an event control module to send different kinds of messages/information to the system components. The event control module includes an event control database, an event control server, a PROBABILITY CALCULATOR to calculate the natural probabilities, and a probability transform function module PROBTRANS (PTF) to transform natural probabilities to the business probabilities, so that the natural probabilities are transformed to generate a hold attractive for the players as well as bookmaker. It further includes at least one Real-time Betting System Server module to transform the probabilities into the odds offered to the customer, the Real-time Betting System Server including an ODDTRANS (OTF),), at least one Real-time Betting System Server to communicate with the betting terminals over the same messaging protocol; a plurality of Betting Devices and Betting Terminals of different kinds, each betting terminals communicating via a network with a bookmaker server and a real-time betting server (RTBS). The a risk management server includes a PION Server to collect all the data from the event control and all bet slips from the betting terminals, a PION database, a RISK ANALYZER to compare the hold situation with the desired hold setting, and a risk analyzer database. The a Bookmaker Service includes a Bookmaker server receiving data from the event control and requests for the parameter calculation, a bookmaker database, a calculation core module (CalCore) for parameter calculation, wherein said bookmaker server functions as a Jackbet Server to provide Jackbet services for Jackpot Management by collecting all bets related to Jackpot from the betting terminals, calculating the winnings, calculating basic probabilities, and obtaining the parameter values for delivering it to the betting terminals. Each Real-time Betting System Server comprises a different hold percentage for different markets in the real-time betting system and each Real-time Betting System Server having a different setting for the hold. The betting terminals include any configuration, such as portable computing devices, Cash Desks, and Web server applications. The betting terminals can also be self-service kiosks where players can put their bets directly to the system and a cash desk application where trained staff accept bets from the players and enter them into the system the betting terminals accepting the bets, calculating the winnings based on the received results and processing the payouts to the players. Further, the betting terminals may be personal computers, smart phones, and tablet computers utilizing software including a betting application and a virtual cash desk application. The system can be implemented via the internet, a local area network, or any network in existence, or to be developed.

The present invention also proposes a method for generation of probabilities and parameter calculation for a real-time betting system (RTBS) comprising the steps of: providing a real-time betting system including—an event control server and event control database, a bookmaker server and a bookmaker database and a jackbet database, a PION server for managing risk including a PION database and a risk analyzer database, a Real-time Betting System Server that enables communication with a plurality of betting terminals, a plurality of betting terminals in operative communication with at least one Real-time Betting System Server and the jackbet database of the bookmaker server.

The method further includes the steps of: identifying a real-time event; generating basic probabilities by communicating with the jackbet database; creating sample data; calculating parameters by further communicating with the bookmaker server and utilizing the sample data; modifying the parameters using CALCORE; calculating and delivering probabilities based on the modified parameters; and using the probabilities to generate odds to enable a payout including a jackpot payout.

The present invention further proposes a method for generating the probabilities and calculating the parameter for the Jackbet using a real-time betting system (RTBS), the method comprises the steps of: identifying for a new event before the probability generation; calculating the probability for the occurrence of event based on the values defined on one side and on the activity on the terminals on the other side; selecting the criterion of the samples for the calculation of the parameter used for the Jackbet by means of the CalCore module; starting the calculation of the parameter used for the Jackbet; generating the parameter to be used for the Jackbet; applying transformation function for transforming the natural probabilities into the business probabilities; delivering calculated parameter to the Jackbet Service; delivering the parameter value to the betting terminals; and the system proceeds to wait for next event.

Here, the event is a slot car race and the selected criterion is the finishing time of the winning car used as Over/Under border for the Under Bet. The meaningful data for the cars are collected from the database for "Layer 0" based on historical event data, i.e. the most recent finishing times of the cars which attend the next race. This includes the steps of: configuring the relevant sample size and the allowing time period in the system settings, collecting historical finishing times of the cars for "Layer 1", if there are not enough data to create a full sample, data from "Layer 0" are higher weighted than data from "Layer 1", collecting independent data from any other cars which do not attend the next race, if there are still not enough data for a full sample, putting these data to "Layer 1". It further includes the steps of collecting meaningful data of the most recent finishing times of the drivers which attend the next race from the database for "Layer 0", configuring the relevant sample size and the allowed time period in the system settings, collecting historical finishing times of the drivers for "Layer 1", if there are not enough data to create a full sample, weighing data from "Layer 0" higher than data from "Layer 1" and collecting independent data from any other drivers, which do not attend the next race, if there are still not enough data for a full sample, putting these data are to "Layer 1".

The calculation of the parameter used for the Jackbet includes the steps of: starting calculation based on Estimating Population Parameters from sample statistics, estimating the population mean as Weighted means with regards to the used Layers, calculating the Confidence Interval critical points under the given Confidence Level for a suitable distance, adding the sample deviation dependent Margin of Errors added to the estimated mean.

In the method in accordance with the present invention, the commercial transformation of the parameters for slot cars is realized by set of functions depending on the holds trend analyzed by the RAL and activating the appropriate function, the function itself is defined by the following formula:

$$t_Trans = t_Calc + (N_Real - N_Avg) * t_Handicap$$

Wherein, t_Trans=Transformed value for the parameter, t_calc=Calculated value for the parameter, N_Real=Number of races since the last occurrence of a race, N_Avg=Average number of races between two Races, and t_Handicap=Value per race added to the calculated value.

For calculating the amount which goes into the Jackpot based on the number of bets played in a certain interval (e.g. a day), the amounts are split into three parts, the first part being the Main Jackpot which is 80%, the second part being a Hidden Jackpot which is 15%, and the third part being the hold of the operator, which is 5%.

Components of the Real-Time Betting System

Event Control

The event control server includes a general purpose computer having memory, a processor, a user interface, and a communications port capable of communicating via a network. The memory, processor, user interface and communications port operate in operative communication with each other and the event control server is programmed with software to enable the operative communication. The event control server sends different kinds of messages and data (information) to the system components. These are information about the Event phase (e.g. New, Place your bets, odds, Finish betting, No more bets, Race, Result for the different kinds of events like slot car races or Table Soccer matches), the probabilities include winner and exacta probabilities for slot car races; result probabilities (1/X/2), and various others such as, for example, first goal and correct score for table soccer, win results and many more.

Inside the event control server, or in an alternate embodiment inside the bookmaker server, there is a probability calculator (PCC) which calculates the natural probabilities (Slot car: all winner probabilities and each exacta combination probability; Table soccer: all result, correct score and first goal probabilities) using a set of monitored factors. Afterwards, the probability transformer (PTF) transforms the natural probabilities to the business probabilities. The problem here is to transform the probabilities in a way that the system generates a hold which is attractive both for the players and the bookmaker.

Real-Time Betting System Server

The real-time betting system server transforms the probabilities inside the odds transfer module (OTF) to the odds offered to the customer. There can be several Real-time Betting System Servers (e.g. different hold percentage for different markets) in the Real-time Betting System. Each Real-time Betting System Server may have a different setting for the hold. In addition, the Real-time Betting System Server communicates with the betting terminals over the same messaging protocol The betting terminals may include any of a variety of configurations, such as portable computing devices, Cash Desks, and Web server applications.

Betting Devices and Betting Terminals

There are different kinds of betting terminals in the system. According to one aspect of the invention, the betting terminals are self-service kiosks where players can put their bets directly to the system and a cash desk application where trained staff accept bets from the players and enter them into the system. The betting terminals accept the bets, calculate the winnings based on the results they receive and process the payouts.

Alternatively, personal computers, smart phones, and tablet computers may be betting terminals. These devices utilize software enabling the present invention, including a betting application and a virtual cash desk application.

In each case, betting terminals communicate via a network with a bookmaker server and a real-time betting server. Accordingly, the present invention can be implemented via the internet, a local area network, or any network in existence, or to be developed.

PION Server

The PION Server collects all the data from the event control and all bet slips from the betting terminals. These data are analyzed with the risk analyzer to compare the hold situation with the desired hold setting. If the difference between these two settings is too large, a detailed analysis finds the odds range and/or the factors of the PCC and PTF which are inappropriate. It then adopts the values of the functions and calculations used inside. Before activating the new set of parameters, it performs an simulation with historical data.

Components of the Real-Time Betting System Jackpot System

Jackbet Service

The Jackbet Service Module includes a jackbet database in communication with the Bookmaker Server 16 to perform Jackpot Management. It collects all bets that are related to Jackpot from the betting terminals and calculates the winnings. Also, the calculation of the basic probabilities is done by the Jackbet Service Module. In addition, it gets the parameter values from the Bookmaker Service and delivers it to the betting terminals.

Bookmaker Service

The Bookmaker server 16 receives data from the event control Server 10 and requests parameter calculation from the event control Server 10. The parameter calculation is done inside the Calculation Core (CALCORE), which is a module of the Bookmaker Server 16.

Description of Jackpots

In gaming, there are different meanings and kinds of Jackpots and Jackpot Systems. In lotteries there are certain winning conditions. All wagers are put to a pot and a certain percentage of these wagers (according to the gaming rules) is then paid to all players that meet the winning conditions. If nobody meets the winning conditions, this pot becomes a jackpot. All wagers remain in the pot until the next draw. So the pot increases until one or more players meet the winning conditions. Typical lotteries have a drawing interval of once or twice a week. Some lotteries do a daily drawing.

Jackpots Systems of slot machines work differently. A number of slot machines are connected to a jackpot. The value of the jackpot increases a small value, every time a game is played on a slot machine that is connected. Usually, only the players that win the combination with the highest payoff, can win the jackpot (progressive jackpot). Additionally, the size of the Jackpot has to have at least a certain predefined value. Normally, only one player can win the Jackpot. In wide area systems, there is a small risk that more than one player can hit the jackpot due to network and system latencies.

A goal of the present invention is to provide a betting Jackpot for a RTBS.

How to Offer Bets that Simultaneously Fulfill Typical Requirements for Sport Betting and for Jackpot Systems.

Jackpot Systems:

Jackpot increases by every game played on a connected machine (CRITERIA 1).

Small part of the wager goes into the Jackpot (CRITERIA 2).

Random payout to one player (CRITERIA 3).

Minimum payout of the Jackpot is configurable (CRITERIA 4).

Sports Betting:

The player has to know the bet (i.e. the winning conditions) (CRITERIA 5).

The player has to know the stake (CRITERIA 6).

The occurrence of winning conditions must not be random (CRITERIA 7).

Real-time betting system: Ideally most players would choose to participate in the real-time betting system Jackpot. Since, it is advantageous to have an extra bet, we use a certain value as stake which is much less than the normal minimum stake. We call this bet Jackbet. For slotcars the preferred stake of the Jackbet is 20% of the minimum stake of normal bets. However, this amount could be in the range of 10-90% of minimum stake of normal bets. The stake for the Jackbet is configurable.

The Jackbet is clearly displayed to the customer and the customer knows the stake (CRITERIA 5 & CRITERIA 6). For slot car races, the Jackbet is either displayed in the area of the bet slips (self-service terminals and online) or printed on the physical bet slips (cash desk solutions). With every Jackbet played by a customer, the Jackpot grows by a small amount (CRITERIA 1 & CRITERIA 2).

The method used to fulfill CRITERIA 7 and CRITERIA 3 includes arriving at winning conditions that are combined in an accumulator bet. For slot car races, we do a combination of a tricast (bet on the first three places in combination) and an Over/Under Bet. The tricast combination is suggested to the player by a random algorithm but can be changed by the player to a different combination. In bigger markets with more machines connected to the Jackpot, the tricast bet is changed to a combination bet of the first 4 places.

The Over/Under bet is: "Is the finishing time of the winner under a certain time?" It is always the "Under" bet and cannot be changed by the player to "Over". The time value can vary from race to race and depends on whether it should be more likely that this condition is true or not. If the desired Jackpot value is reached, the time will be set to a value that is more likely to be beaten by the slot car drivers.

How to Assure the Desired Jackpot Drop Rate with Sports Betting Mechanisms?

One of the main problems the operator faces is the configuration of a Jackpot. If the Jackpot drops too often, the winning amount is not attractive enough. Otherwise, if the interval of Jackpot drops is too long, the players are also not attracted. While gaming slot machines are automatically connected to a Jackpot, the players that play on these machines automatically participate. In a RTBS, this is different, and the players can decide whether they want to participate or not.

Based on the number of bets played in a certain interval (e.g. a day), we can calculate the amount which goes into the Jackpot. The amounts are split into three parts. The first part is the Main Jackpot, the second part is a Hidden Jackpot, and the third part is the hold of the operator which should be very small. A typical breakup is 80% for the Main Jackpot, 15% for the hidden Jackpot and 5% hold for the operator.

After defining the average interval of how often the Jackpot shall drop (e.g. once every day), we know the average size of the Betting Jackpot, which is then the desired Pot size. The Jackpot Service monitors the number of players participating in the Jackpot. Depending on the average number of Jackbets, the probability of the offered odds has to be adopted. One part of the Jackbet (i.e. the tricast) cannot be modified. There is a certain range of odds, depending on the natural driver winning probabilities. The other part is the Over/Under Bet and here it is possible to adapt the Over/Under Parameter according to the needed probabilities. This is a normal bookmaker mechanism, which is used for in-play betting with Over/Under and Handicap Bets.

How to Make the Betting Jackpot More Attractive?

Players can decide whether they want to place Jackbets or not. Thus, it may be advantageous that the Jackpot does not start with a zero-value. So, the first Jackpot starts with a predetermined default minimum value. After the Jackpot drops, a new Jackpot starts either again with the default minimum value or with the value of the hidden Jackpot, depending on which one of the two values is higher.

There can be a situation after the restart of a Jackpot that it is not attractive enough. For this situation, the idea is that races in which the winning time is "Under" the defined finishing time, are marked as Jackpot races and this fact is presented to the players by means of special animations.

If there are fewer players placing Jackbets, the probability of the Over/Under bet and the probability of the occurrence of a Jackpot race has to increase. In other words the fewer players are placing Jackbets, the more races have to be Jackpot races. And if there are more Jackpot races, it is more likely for the single customer to hit the Jackpot and thus this is the way to bring more players to the terminals. Accordingly, the probability of a Jackpot race depends on the number of players placing Jackbets.

Probabilities Generation & Parameter Calculation

This section documents the process of generating the probabilities and calculating the parameter (e.g. Over/Under border in slot cars) for the Jackbet (compare FIG. 2).

The probability generation waits until a new event is provided.

Based on the values which are defined for the "Desired Race Pot Value" and "Stake Percentage Primary Pot" on the one side and the activity on the terminals on the other side, the probability for the Race 66 occurrence is calculated (compare FIG. 3).

The next step is the criterion of the samples for the calculation of the parameter, which is used for the Jackbet. For slot car races, this is the finishing time of the winning car which is used as Over/Under border for the Under Bet. This is done by the CalCore.

a. Based on historical event data, meaningful data for the cars are collected from the database for "Layer 0". This means, the most recent finishing times of the cars which attend the next race. The relevant sample size and the allowed time period is configured in the system settings.
b. If there are not enough data to create a full sample, historical finishing times of the cars are collected for "Layer 1". Data from "Layer 0" are higher weighted than data from "Layer 1".
c. If there are still not enough data for a full sample, independent data are collected. Independent data are data from any other cars which do not attend the next race. These data were put to "Layer 1".
d. Meaningful data for the drivers are collected from the database for "Layer 0". These means, the most recent finishing times of the drivers which attend the next race. The relevant sample size and the allowed time period is also configured in the system settings.
e. If there are not enough data to create a full sample, historical finishing times of the drivers are collected for "Layer 1". Again data from "Layer 0" are higher weighted than data from "Layer 1".
f. If there are still not enough data for a full sample, independent data are collected. Independent data are data from any other drivers, which do not attend the next race. These data are also put to "Layer 1".

Now, the calculation of the parameter, which is used for the Jackbet, starts. The calculation is based on Estimating-Population-Parameters from sample statistics. The population mean is estimated as Weighted means with regards to the used Layers (i.e. actuality of the sample data). For the given Confidence Level (compare "Probability of Race66 occurrence" in FIG. 3), the Confidence Interval critical points are calculated. For our parameter calculation, we need a suitable distance under the given confidence level. This is done by calculating the sample deviation dependent Margin of Errors, which are added to the estimated mean.

After the calculation of the parameter, a transformation according to the business needs is applied. The goal is to make the Jackbet as attractive as possible. Therefore, it is necessary to compare the number of races since the last Race 66 with the "Average number of races between two Race 66" (see FIG. 3) and according to the Transformation function to adopt the parameter if necessary.

The calculated parameter is delivered to the Jackbet Service.

The Jackbet Service delivers the parameter value to the betting terminals.

The system proceeds at step 1 (waiting for next race).

Commercial Transformation of the Parameter for Slot Car Races

The commercial transformation is realized by set of functions. In dependency of the holds trend analyzed by the (RAL), the appropriate function is activated.

The function itself is defined as following:

$$t_Trans = t_Calc + (N_Real - N_Avg) * t_Handicap$$

t_Trans Transformed value for the parameter t_calc Calculated value for the parameter N_Real Number of races since the last occurrence of a Race66

N_Avg Average number of races between two Race66 t_Handicap Value per race added to the calculated value

Note: The function is only applied to the parameter if the number of races since the last occurrence of a Race66 is a certain percentage above the "Average number of races between two Race66". The percentage is defined in the system settings.

Glossary:

| Term | Description |
|---|---|
| RTBS | Is an acronym for "Real-time Betting System". |
| PROBCALC (PCC) | Denotes the module that calculates the natural probabilities. |
| PROBTRANS (PTF) | The module and service that transforms the natural probabilities into commercial probabilities in order to meet commercial demands. |
| RISKALYZER (RAL) | A module and service that analyzes the current holds situation with the desired hold setting. |
| ODDTRANS (OTF) | A module and service that transforms the probabilities to odds offered to the customers. |

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the embodiments.

Some portions of the detailed description which follows are presented in terms of methods, procedures, steps, logic blocks, processing, and other symbolic representations of operations on data bits that can be performed on computer memory. Each step may be performed by hardware, software, firmware, or combinations thereof.

Any examples of a database given are thus illustrative of arrangements for the storage of information. Similarly, examples of network topology are illustrative and other topologies may be used.

It will be readily apparent to one of ordinary skill in the art that the various methods described herein may be implemented by, e.g., appropriately programmed general purpose computers, special purpose computers and computing devices. Typically a processor e.g., one or more microprocessors, one or more microcontrollers, one or more digital signal processors will receive instructions e.g., from a memory or like device, and execute those instructions, thereby performing one or more methods defined by those instructions.

A "processor" means one or more microprocessors, central processing units CPUs, computing devices, microcontrollers, digital signal processors, or like devices or any combination thereof.

Thus, a description of a method is likewise a description of an apparatus for performing the method. The apparatus that performs the method can include, e.g., a processor and those input devices and output devices that are appropriate to perform the method.

Further, programs that implement such methods as well as other types of data may be stored and transmitted using a variety of media e.g., computer readable media in a number of manners. In some embodiments, hard-wired circuitry or custom hardware may be used in place of, or in combination with, some or all of the software instructions that can implement the methods of various embodiments. Thus, various combinations of hardware and software may be used instead of software only.

The term "software" refers to any instructions encoded on any medium, a plurality of the same, or a combination of different media, that participate in providing data e.g., instructions, data structures which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency RF and infrared IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data e.g. sequences of instructions to a processor. For example, data may be delivered from RAM to a processor; ii carried over a wireless transmission medium; iii formatted and/or transmitted according to numerous formats, standards or protocols, such as Ethernet or IEEE 802.3, SAP, ATP, Bluetooth•, and TCP/IP, TDMA, COMA, and 3G; and/or iv encrypted to ensure privacy or prevent fraud in any of a variety of ways well known in the art.

Thus, a description of a method is likewise a description of a computer-readable medium storing a program for performing the method. The computer-readable medium can store in any appropriate format those program elements which are appropriate to perform the method.

Just as the description of various steps in a method does not indicate that all the described steps are required, embodiments of an apparatus include a computer/computing device operable to perform some but not necessarily all of the described method.

Likewise, just as the description of various steps in a method does not indicate that all the described steps are required, embodiments of a computer-readable medium storing a program or data structure include a computer-readable medium storing a program that, when executed, can cause a processor to perform some but not necessarily all of the described method.

Where databases are described, it will be understood by one of ordinary skill in the art that i) alternative database structures to those described may be readily employed, and ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats including relational databases, object-based models and/or distributed databases could be used to store and manipulate the data types described herein. Likewise, object methods or behaviors of a database can be used to implement various methods, such as the described herein. In addition, the databases may, in a known manner, be stored locally or remotely from a device which accesses data in such a database.

Various embodiments can be configured to work in a network environment including a computer that is in communication e.g., via a communications network with one or more devices. The computer may communicate with the devices directly or indirectly, via any wired or wireless medium e.g. the Internet, LAN, WAN or Ethernet, Token Ring, a telephone line, a cable line, a radio channel, an optical communications line, commercial on-line service providers, bulletin board systems, a satellite communications link, a combination of any of the above.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a method is described, in an embodiment the method may operate without any user intervention. In another embodiment, the method includes some human intervention e.g., a step is performed by or with the assistance of a human.

BRIEF DESCRIPTION OF THE DRAWINGS

FIG. 3 is a table defining probabilities for Race66 occurrences depending on active betting terminals.

DETAILED DESCRIPTION

Figure 1:
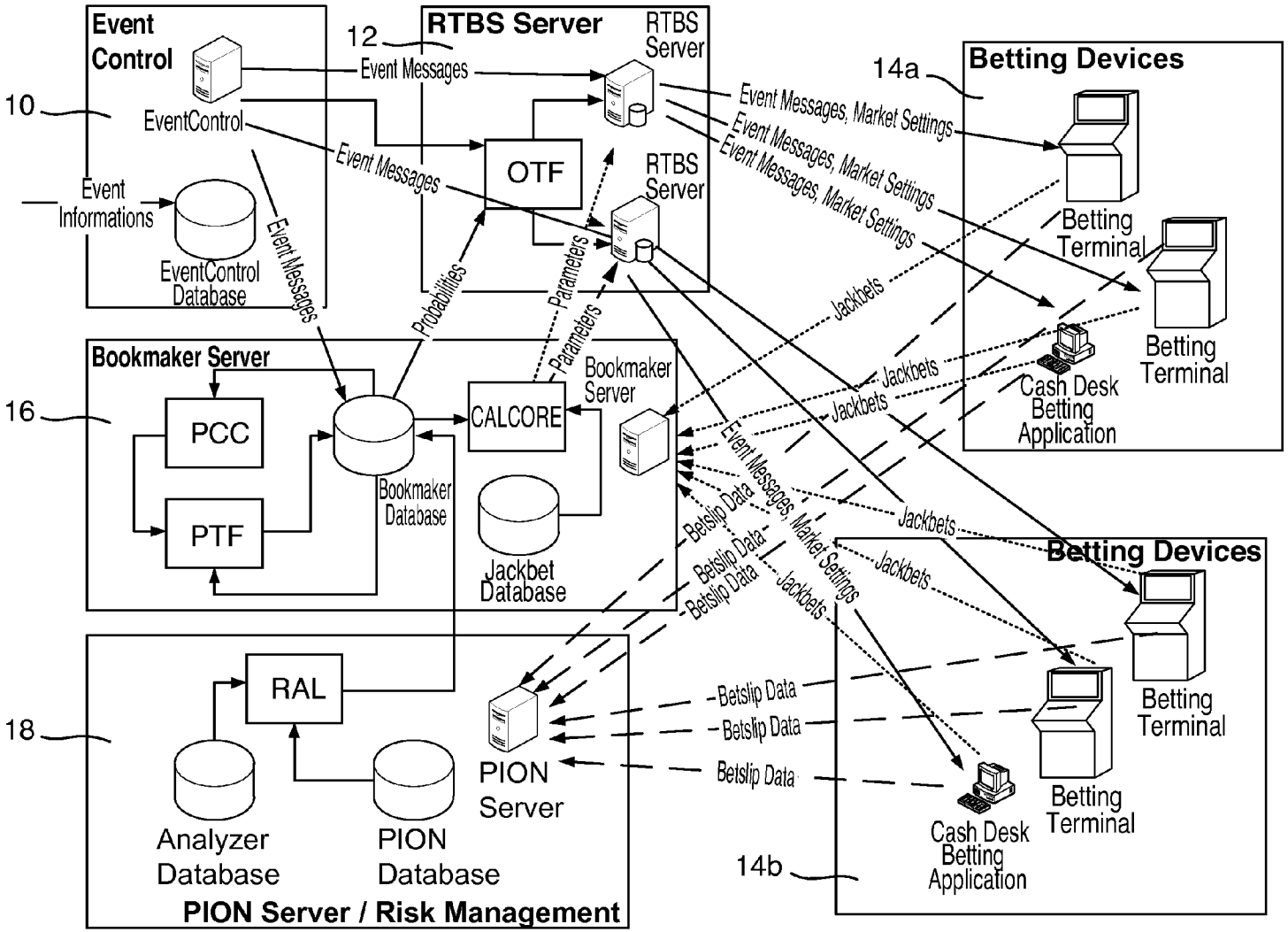
FIG. 1 is a system diagram in accordance with the present invention.

FIG. 1 shows a Real-time Betting System. The system includes event control server 10, at least one Real-time Betting System Server 12, a bookmaker server 16, risk analyzer server (RAL) 18, and betting devices 14*a* and 14*b*. These devices are connected in operative communication with each other.

The event control server 10 includes a general purpose computer having a memory, processor, a user interface, and a communications port, all in operative communication, for regulating event control including receiving event information from external sources.

The event control server 10 also includes event control databases that store event information from external sources. The event control server 10 communicates event messages to at least one Real-time Betting System Server 12. The event control server 10 also communicates event messages directly to the bookmaker server 16.

The bookmaker server 16 includes a general purpose computer having memory, a processor, a user interface and a communications port. The bookmaker server 16 is programmed with software to enable functioning as a bookmaker server. The bookmaker server 16 includes a bookmaker database and a jackbet database. The bookmaker server 16 also includes a probability calculator module, referred to as PROBCALC or (PCC) for calculating natural probabilities. The bookmaker database communicates business probabilities to at least one Real-time Betting System Server.

For example, when the event is a slot car race, all winner probabilities and each exacta combination probability. For example, when the event is a table soccer match, all results, correct score and first goal probabilities using a set of monitored factors.

The bookmaker server 16 also includes a probability transform function module, referred to as PROBTRANS or (PTF), for transforming natural probabilities to business probabilities. Optimally the probability transform function module transforms the probabilities in such a way that the system generates a hold which is attractive both for the players and the bookmaker.

The bookmaker server 16 also includes a calculation core module, referred to as CALCORE. The calculation core module communicates parameters to at least one Real-time Betting System Server 12.

The risk analyzer server 18 includes general purpose computer functioning as a PION server. The PION server receives slip data from betting devices 14*a* and 14*b*. The PION server is in operative communication with the risk analyzer database, the PION database and the risk analyzer module. The risk analyze module evaluates risks communicates the evaluated risks to the bookmaker database of the bookmaker server 16.

The betting devices 14*a* and 14*b* each include betting terminals including a general purpose computer having memory, a processor, a user interface and a communications port in operative communications with each other. The betting terminals are programmed with a cash desk betting application.

In an alternate embodiment, the betting terminals and the cash desk betting application include computing device such as a laptop computer, a desktop computer, notepad computer, or a smart phone, where the shooting devices program with the cash desk betting application software to enable the present invention.

The Real-time Betting System Server 12 includes an odds transfer module referred to as ODDSTRANS (OTF) and at least one general purpose computer functioning as a Real-time Betting System Server.

The Real-time Betting System module 12 transforms the probabilities inside the ODDTRANS (OTF) to the odds offered to the player. There can be several Real-time Betting System Servers (each providing a particular hold percentage for each market, market class, or geographical region served by the present invention.

Each Real-time Betting System Server has a different setting for the hold percentage according to one aspect of the invention. In addition, the Real-time Betting System Server communicates with the betting devices 14*a* and 14*b* via a common messaging protocol. The betting devices 14*a* and 14*b*, and thus the betting terminals may include any of a variety of configurations such as portable computing devices, Cash Desks, and web server applications.

The Real-time Betting System Server 12 communicates event messages unique market settings to each betting device 14*a* and 14*b*. The unique market settings can be updated as required to be unique demands and market served by the present invention.

Figure 2:
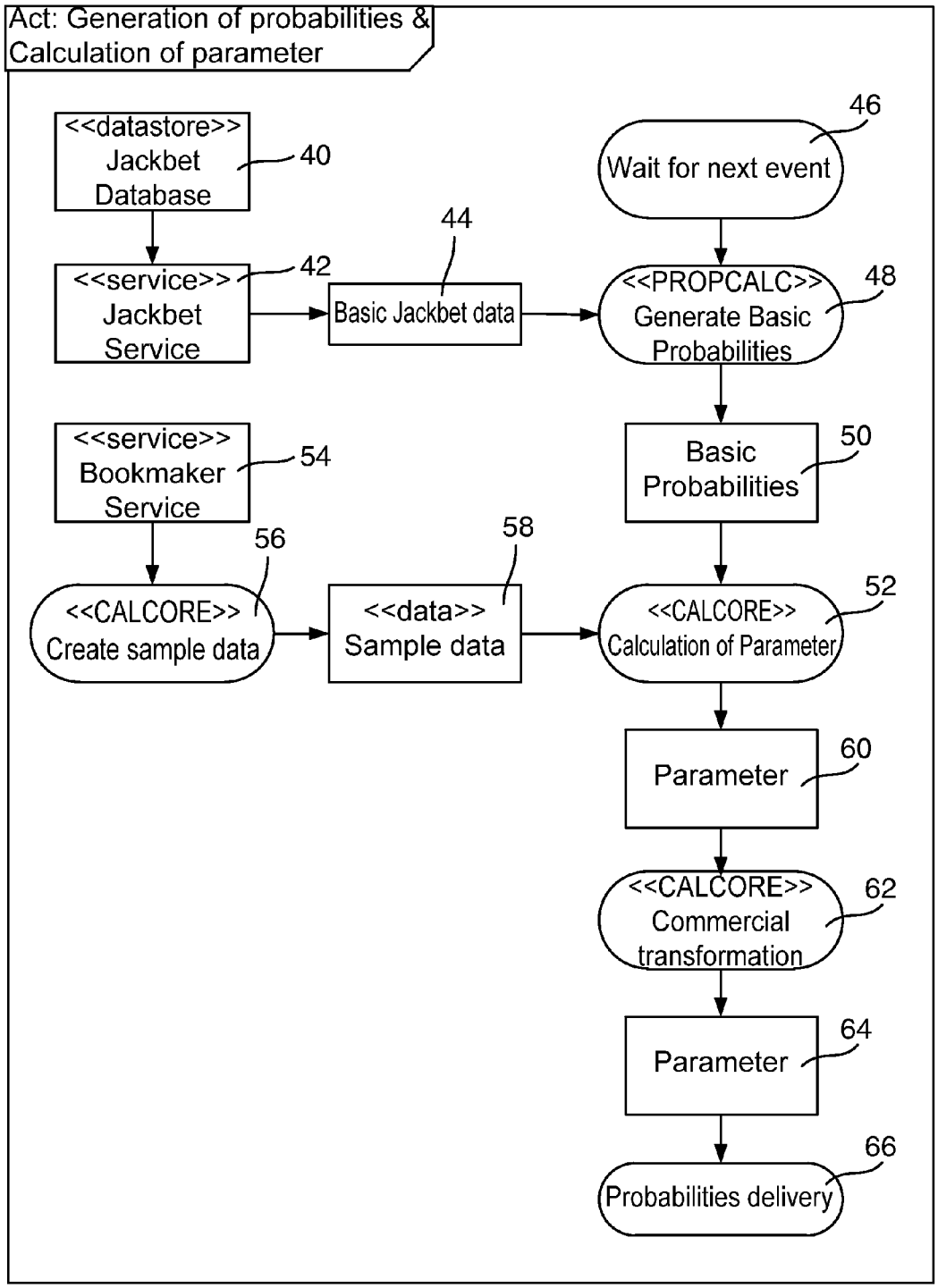
FIG. 2 is a flow chart showing the recurring method of the probability and parameter calculation.

FIG. 2 shows a flowchart of a method of generating probabilities and calculating parameters in accordance with the present invention. The flowchart includes the step 40 of storing data in the jackbet database referred to as <<data store>>. The step 42 provides a jackbet service referred to as <<service>> to enable the step 44 of generating basic jackbet data. The basic jackbet data is communicated to the probability calculator to enable the step 48 of generating basic probabilities referred to as <<PROPCALC>>.

The step 46 waits for the next event. Upon receipt of an event message from the event control server 10, the step 48 generating basic probabilities commence. Step 50 establishes the basic probabilities and the step 52 calculates parameters, referred to as <<CALCORE>>. Step 52 relies on the step 58 of providing sample data, referred to as <<data>>.

Step 54 provides bookmaker service, referred to as <<service>>. Step 56 creates sample data utilizing the bookmaker service step 54. Step 56 is also referred to as <<CALCORE>>.

The step 60 generates parameters from the step 58 of providing sample data, from step 50 establishing the basic probabilities, and from step 52 of calculating parameters.

Step 62 enables commercial transformation from the step 60 of generating parameters. The step 64 generates commercial parameters. Step 66 delivers probabilities.

FIG. 3 is a table showing how jackpot hit rate depends on the number of terminals and the total stake race and on a number of races. The table of FIG. 3 also shows the number of race 66 events needed to hit the jackpot and the probability of a race 66 occurrence.

According to FIG. 3, when a number greater than 500 terminals are active, the total stake per race is maximized, and the jackpot hit rate and the probability of race66 occurrences, are maximized. Race66 is an example of a particular race presented by the system to various betting devices, including betting devices 14*a* and 14*b*.

The Number of Race66 occurrences, the number of races needed for desired race pot value, and the average number or races between two Race66 occurrences, are minimized. Accordingly, it is optimal to have at least 100, and preferably, at least 500 terminals active for game play to maximize the interest of players, because players desire to maximize their odds of hitting a jackpot. Accordingly, the present invention is preferably intended to serve more than one, and perhaps more than five hundred betting devices, and betting terminals. While many casinos lack five hundred betting devices, the present invention can serve many casino customers in numerous locations globally via a network such as the Internet, serving at least five hundred customers.

Figure 4:
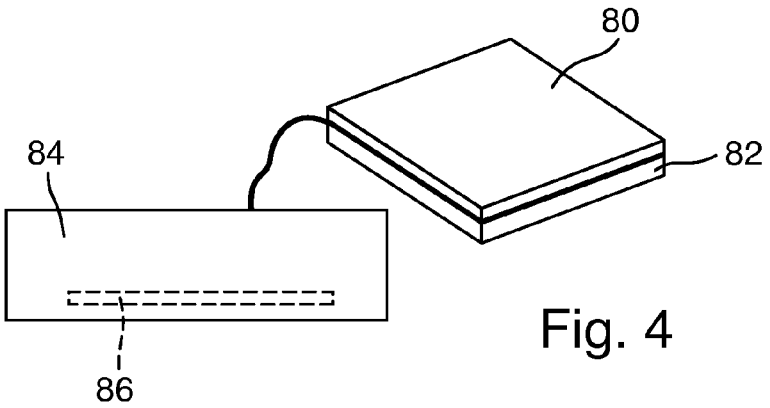
FIG. 4 shows a computer used as in betting terminal in accordance with the present invention.

FIG. 4 shows a computer 84 mounted in the betting terminal of a gaming machine. The computer 84 is connected to a display 80. The display 80 includes a transmissive LCD panel and may also include an integrated touchscreen 82. The computer 84 includes a PCB as the main board having a controller, memory for storing software for operating the display 80 which is also connected to the main board, software drivers, and a main processor, all mounted on the PCB.

Figure 5:
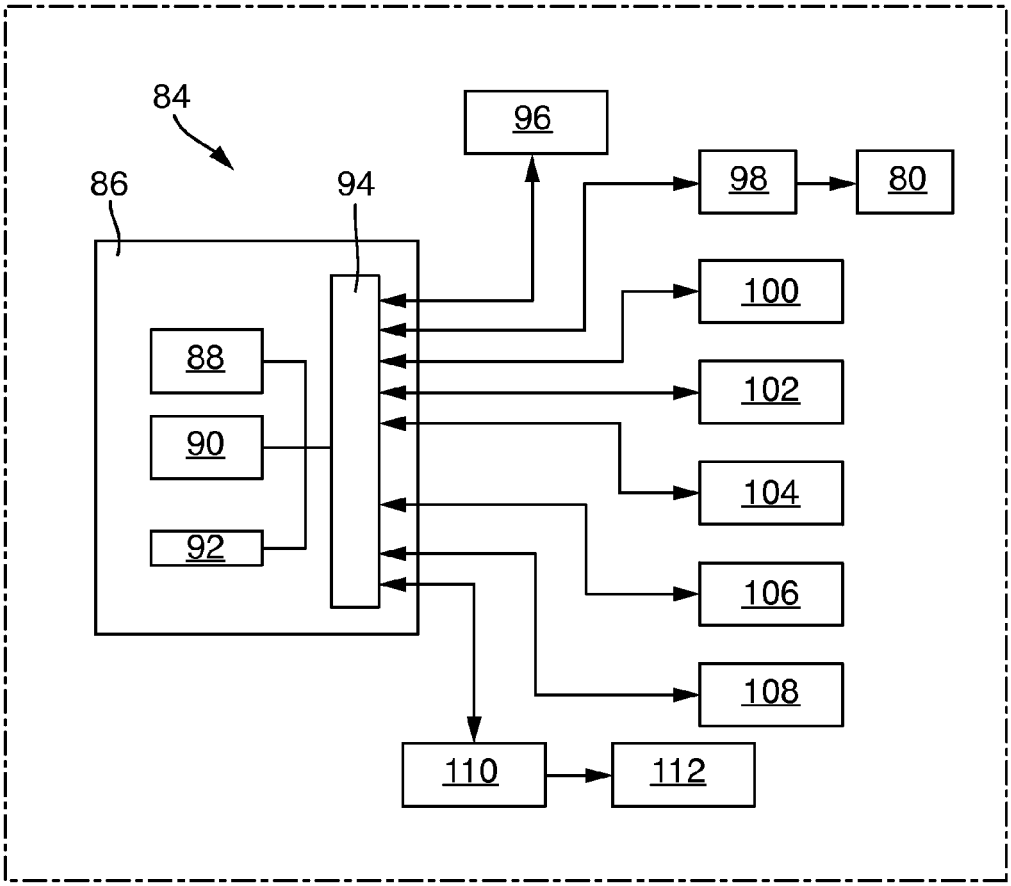
FIG. 5 is a system diagram for a betting terminal in accordance with the present invention.

FIG. 5 shows a system diagram of the computer 84 integrated in a betting terminal in accordance with the present invention. The computer 84 includes a main board 86 or PCB, a program memory 88 configured as a computer readable medium, a main processor 90 and read only memory or RAM 92, all connected in operative communication with each other and also connected with an input output I/O controller 94 which in turn communicates with a user interface control panel 96, the display interface driver circuitry 98, a display unit 100, a coin receiver 102, a bill receiver 104, a card reader 106, a ticket reader/printer 108, and a sound circuit 110 respectively. The sound circuit 110 is in operative communication with speakers 112.

The coin receiver 102 and bill receiver 104 receive the respective currency and communicate the amount received therein to the I/O controller 94. The card reader 106 reads credit cards, debit cards, gift cards or other cards having electronic indicia of the monetary value.

The ticket reader 108 prints tickets and receipts revealing the winnings of a player, or other financial outcomes. The ticket reader 108 also receives tickets having indicia of monetary value, such as a bar code, which is read by the ticket reader 108.

The sound circuit 110 is configured to provide an acoustic-based interface for the user. Each movement or action by a user may result in a particular sound, or instruction being generated by the computer 84. The speakers 112 communicate the sounds to the user.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of moveable images, defining a matrix column, that are used to establish a payout. The term "random" or "randomly" are to be broadly defined herein to include pseudo-random, or pseudo-randomly, respectively. Accordingly, the scope of the invention is defined by the appended claims.

I claim:

1. A real-time betting system configured to enable real-time betting on events with a short interval, comprising:

an event control server having memory, a processor in communication with the memory and a means for communicating data in operative communication with the processor to enable communication of the data via a network;

the event control server includes an event control software configured to communicate event data to system components and an event control database for collecting and storing the event data, the event data including event phase data;

a real-time betting system server in operative communication with the event control server, the event control server includes a probability transformer for transforming natural probabilities related to the event data into odds;

a bookmaker server in operative communication with the event control server configured to receive the event data, request parameter calculation from the event control server and enable bets in accordance with the received event data and parameter calculation;

the real-time betting system server configured to enable the bets using the odds, the bet having a first stake, and an optional jackbet having a second stake that is less in value than the first stake, and to enable a secondary payout for each bet enabled by the bookmaker server, the bet having the first stake, and a secondary payout for a successful jackbet result;

a plurality of betting terminals in communication with the bookmaker server for communicating the bets to the bookmaker server, the plurality of betting terminals being in operative communication with the real-time betting system server for receiving the event data;

when a jackbet is placed, the real-time betting system server calculates a jackpot payout probability for jackbets based on a number of betting terminals receiving jackbets, the total of all first and second stakes of all betting terminals receiving jackbets and a number of the events;

the plurality of betting terminals each include a payment device selected from the group consisting of: a coin receiver, a bill receiver, a card reader, a ticket reader, and combinations thereof;

wherein the events have the short interval which is less than two minutes, and are selectively communicated to the betting terminals to enable the bets to be placed; and wherein the probability transformer transforms the probabilities related to the event data into the odds using a transformed value of a parameter using the formula:

$$t_Trans = t_Calc + (N_Real - N_Avg) * t_Handicap;$$

wherein, t_Trans is the transformed value for the parameter, t_calc is a calculated value for the parameter, N_Real is a number of races since a last occurrence of a Jackpot race, N_Avg is an average number of races between two Jackpot races, and t_Handicap is a value per race added to the calculated value.

2. The real-time betting system as set forth in claim 1, wherein the events with the short interval include events selected from the group consisting of: slot car races, horse races, automotive races, dog races, sporting events, and segments of such events.

3. The real-time betting system as set forth in claim 2, wherein the betting terminals are configured to enable bettors to place a tricast bet on a first place finisher, a second place finisher and a third place finisher.

4. The real-time betting system as set forth in claim 3, wherein the tricast bet includes enabling a selection of a finish time of the winner by the betting terminals, wherein the finish time has a maximum duration.

5. The real-time betting system as set forth in claim 2, wherein for the slot car race events, the probabilities related to event information include all winner probabilities and exacta probabilities.

6. The real-time betting system as set forth in claim 1, wherein results for table soccer match events include the result 1/X/2, first goal and correct score.

7. The real-time betting system as set forth in claim 1, wherein each Real-time Betting System Server stores a custom hold percentage for each market where the betting terminals are located.

8. The real-time betting system as set forth in claim 7, wherein the betting terminals include kiosk-style casino gaining machines.

9. The real-time betting system as set forth in claim 7, wherein the betting terminals include personal computing devices.

10. The real-time betting system as set forth in claim 8, wherein the betting terminals are programmed to enable players to enter bets directly to the system, and include a cash desk application for calculating winnings based on event result information received from the real-time betting system server, the cash desk application is enabled to process payouts to players.

11. The real-time betting system as set forth in claim 7, wherein the betting terminals include personal computers, smart phones, and tablet computers utilizing software including a betting application and a virtual cash desk application.

12. The real-time betting system as set forth in claim 1, wherein the system communicates via the Internet.

* * * * *